United States Patent [19]

Kaven

[11] Patent Number: 4,862,959

[45] Date of Patent: Sep. 5, 1989

[54] SELF-ADJUSTING BIT BASKET

[75] Inventor: Allen H. Kaven, Sudbury, Canada

[73] Assignee: Inco Limited, Toronto, Canada

[21] Appl. No.: 144,558

[22] Filed: Jan. 14, 1988

[30] Foreign Application Priority Data

Jan. 22, 1987 [CA] Canada ..... 527901

[51] Int. Cl.[4] ..... E21B 19/18

[52] U.S. Cl. ..... 166/77.5; 166/85; 285/39

[58] Field of Search ..... 166/77.5, 85, 378, 379; 175/423; 285/39

[56] References Cited

U.S. PATENT DOCUMENTS

| | | | |
|---|---|---|---|
| 1,113,659 | 10/1914 | Lebus | 166/77.5 |
| 2,263,267 | 11/1941 | Franklin | 255/35 |
| 3,258,278 | 6/1966 | Miller, Jr. | 285/39 |
| 3,698,266 | 10/1972 | Mader | 81/53 |
| 4,030,542 | 6/1977 | Poe et al. | 166/77.5 |
| 4,111,388 | 9/1978 | Presley | 166/85 |
| 4,305,438 | 12/1981 | Spinosa et al. | 285/39 |
| 4,495,840 | 1/1985 | Freitag et al. | 81/54 |
| 4,520,879 | 5/1985 | MacElvain | 173/577 |

FOREIGN PATENT DOCUMENTS

| | | | |
|---|---|---|---|
| 1146404 | 3/1985 | U.S.S.R. | 166/85 |
| 2082654 | 3/1982 | United Kingdom | 166/85 |

*Primary Examiner*—Jerome W. Massie, IV
*Assistant Examiner*—Terry Lee Melius
*Attorney, Agent, or Firm*—Edward A. Steen; Francis J. Mulligan, Jr.

[57] ABSTRACT

A bit basket mounted on a drilling rig for making and breaking drill string connections. A movable "Y"-like shaped cam is swivelly mounted within a body. Drill string components, such as drill bits and hammers, extend into the basket. The cam has an arcuate engaging face with two tip ends. The cam is thrown so as to engage and hold the component stationary. The connection is then made or broken by the requisite rotation of the drill string by the drilling rig.

5 Claims, 1 Drawing Sheet

SELF-ADJUSTING BIT BASKET

TECHNICAL FIELD

The instant invention relates to drilling in general and, more particularly, to bit baskets for use with drilling rig components.

BACKGROUND ART

With the advent of vertical retreat mining methods, corresponding new in-the-hole ("I-T-H") drilling units are being introduced. As the technology has progressed, there has been a decided push to automate and otherwise improve current and newly developed I-T-H drills.

It is conventional practice to fabricate drill string components such as pipes, hammers, etc. with wrenching slots. Accordingly, I-T-H percussion hammers usually have a chuck part (or bottom hammer subassembly) slotted for a fork-table wrench. In this fashion, in order to attach or detach the hammer from the bit the wrench is slipped over the flats of the slot of the hammer to either make or break the connection with the stem of the bit.

By virtue of the current slotted design of the hammer, the process of slotting the flats cuts through the outer case hardened surface of the hammer which ultimately causes premature wear. Moreover the constant extension and retraction of the wrench ultimately causes the flats to strip and wear out thereby making it more and more difficult to attach/detach the hammer from the bit. Ultimately the exterior of the worn hammer must be remachined or if that fails, the entire unit disposed of.

SUMMARY OF THE INVENTION

Accordingly, there is provided a bit basket that eliminates the need for the flats on the chuck of the hammer or pipe. The basket is preferably disposed on a drill rig where it can selectively open and close about the sludge grooves of a drill bit. By holding the bit in place the hammer or pipe may be rotated in the desired direction to make or break the connection.

PREFERRED MODE FOR CARRYING OUT THE INVENTION

Figure 1:
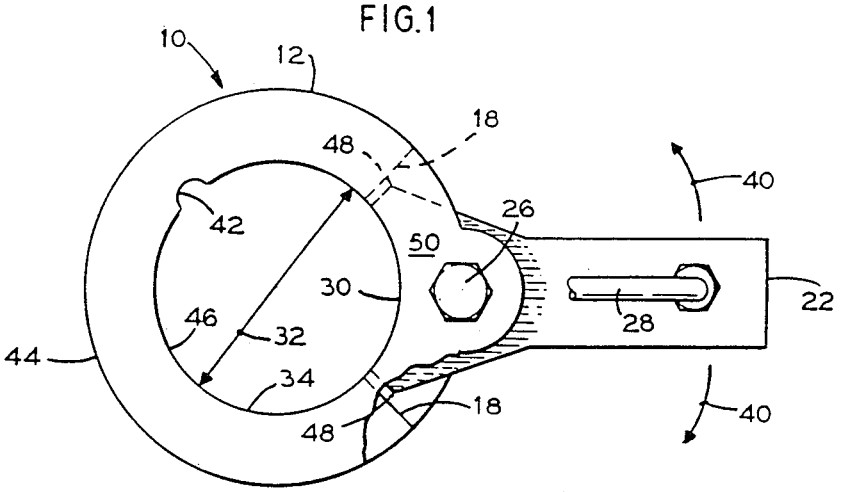
FIG. 1 is a plan view of an embodiment of the invention.
Figure 2:
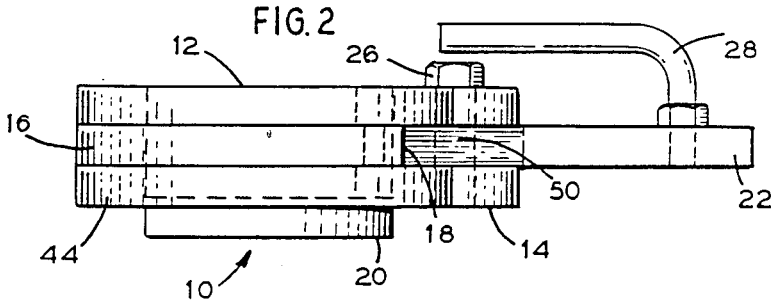
FIG. 2 is side elevation of FIG. 1.

Referring to FIGS. 1 and 2, there is shown bit basket 10. The bit basket 10 is comprised of upper ring 12, lower ring 14 and intermediate ring 16. The intermediate ring 16 is incomplete having ends 18 forming void 50. The three rings 12, 14 and 16 comprise body 44 having aperture 46 of predetermined internal diameter 32.

Groove 42 is formed in the three rings 12, 14 and 16 which may be welded together. The lower ring 14 includes a key 20 (see FIG. 2) for installation in a drill table 24 (see FIG. 3) mounted on a drill rig.

Y-shaped cam 22 is swivelly disposed between the upper ring 12 and the lower ring 14 and held in place by fastener 26. A handle 28 expedites swivel movement of the cam 22; the fastener 26 acting as the pivot. The cam 22 includes an arcuate proximal bit engaging face 30. The face 30 has tip ends 48. The engaging face 30 is manufactured to be flush with the internal circumference 34 of the aperture 46. Accordingly, the arc of the engaging face 30 is partially congruent with the internal circumference 34 of the aperture 46.

The invention and manner of applying it may be better understood by a brief discussion of the principles underlying the invention.

The bit basket 10 eliminates the need for flats on the chuck of a hammer or rod. This extends the lifetime of the equipment. Moreover, the movable cam 22 permits the bit basket 10 to self-adjust by accommodating the inevitable wear experienced by the bit.

Figure 3:
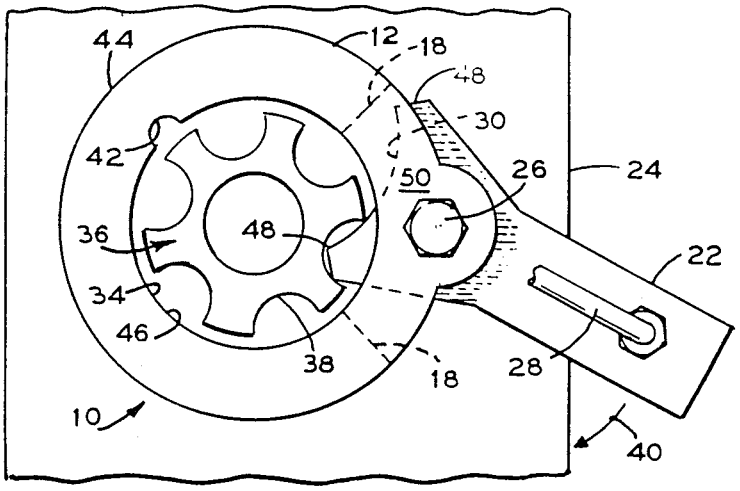
FIG. 3 is a plan view of the invention engaging a bit.

The operation of the bit basket 10 may be visualized by reference to FIG. 3. The drill table 24 is usually mounted on a drill rig and oriented over a hole. In order to remove a drill bit 36 from a hammer, the drill string is withdrawn from the hole until the engaging face 30 of the cam 22 is approximately at the same level as the conventional sludge grooves 38 of the bit 36. (A typical drill bit 36 has about four to eight sludge grooves 38 arranged along the external periphery of the bit 36. They allow the cuttings and sludge to flow away from the cutting surfaces of the bit 36 when it is in the hole). The cam 22 is thrown (either manually via handle 28 or automatically via external power) within the void 50 so that one of the tips 48 on the engaging face 30 registers against a sludge groove 38. This will lock the bit 36 and prevent it from rotating. The drill motor is then activated to rotate thereby breaking the connection between the bit 36 and the hammer. Without engaging the flats on the hammer (which are now superfluous), the hammer is spared the debilitating stripping and rounding action accompanying making and breaking connections found in previous designs. Moreover, the bit basket 10 eliminates the need for cutting through the case hardened surface of the hammer. Rather, the ultimately expendable bit is forced to make and break the connections.

In order to make a connection the above procedure is reversed.

By allowing the cam 22 to swing through an arc 40, the self-adjustable bit basket 10 can accommodate the inevitable wear to the sludge grooves 38. As the sludge grooves 38 wear out, the cam 22 is swiveled in a proportionally larger arc to prevent slippage. Existing basket designs are not adjustable and are sized for a single dimension. As the bit loses its gauge the conventional fixed baskets lose their effectiveness.

It is desirable to have the engaging face 30 flush with the internal circumference 34 so as to permit unencumbered vertical travel of the drilling components when the bit basket 10 is in the "neutral mode", i.e., as in FIG. 1. In addition the groove 42 acts as a sludge groove for the bit basket 10 to permit entrained material to escape when the drill is operating.

The self-adjustable bit basket 10 may be fitted on all types of surface rigs as well as I-T-H drills.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property of privilege is claimed are defined as follows.

1. An improved bit basket, the bit basket communicating with a drilling apparatus, the bit basket adapted to make and break drill component connections, the improvement comprising a bit basket body, the bit basket body having an internal aperture of known circumference, a single movable cam affixed to the bit basket body for engaging a drilling component disposed within the aperture, the cam including a component engaging face substantially congruent with the circumference of the aperture, the cam having a proximal "Y"-like shape, the component engaging face having tips for contacting the drill component, and the engaging face rotatably extendable into the aperture to engage a first groove of the drill component and prevent the drill component from rotating.

2. The improved bit basket according to claim 1 wherein a pair of rings sandwich an intermediate partial ring, the cam pivotally disposed within a void formed by the ends of the intermediate partial ring.

3. The improved bit basket according to claim 1 wherein a second groove extends along the aperture.

4. The improved bit basket according to claim 1 wherein the first groove comprises a sludge groove of a drill bit and the component engaging face communicates with the sludge groove.

5. The improved bit basket according to claim 1 wherein one of said tips registers against the sludge groove.

* * * * *